United States Patent [19]

Oslin et al.

[11] 4,201,333

[45] May 6, 1980

[54] FARE COLLECTION APPARATUS

[75] Inventors: G. Robert Oslin, Chicago; Clarence Seamans, Elk Grove Village, both of Ill.

[73] Assignee: Qonaar Corporation, Elk Grove Village, Ill.

[21] Appl. No.: 909,275

[22] Filed: May 24, 1978

[51] Int. Cl.[2] ..... G07B 15/00

[52] U.S. Cl. ..... 232/7; 232/16

[58] Field of Search ..... 232/7, 15, 16, 11

[56] References Cited

U.S. PATENT DOCUMENTS

| | | | |
|---|---|---|---|
| Re. 28,307 | 1/1975 | Dominick et al. | 232/7 |
| Re. 28,308 | 1/1975 | Dominick et al. | 232/16 |
| 1,076,584 | 10/1913 | Kohler | 232/15 |
| 1,173,258 | 2/1916 | Gebhart | 232/15 |
| 3,667,485 | 6/1972 | Sesko | 232/7 X |
| 3,670,955 | 6/1972 | Dominick | 232/7 |
| 3,693,870 | 9/1972 | Dominick | 232/16 |
| 3,773,252 | 11/1973 | Jensen | 232/15 X |
| 3,807,628 | 4/1974 | Bock | 232/7 X |
| 3,966,116 | 6/1976 | Dominick et al. | 232/7 |

*Primary Examiner*—William H. Schultz
*Assistant Examiner*—Peter A. Aschenbrenner
*Attorney, Agent, or Firm*—McDougall, Hersh & Scott

[57] ABSTRACT

An apparatus for receiving currency which includes a housing having a deposit section and a recess for removably receiving a box for holding the currency. Passages for the currency are defined within the deposit section, and entries are defined by the box communicating with the passages. The box includes a blocking plate normally closing the entries with first and second locking means holding the plate in blocking position to prevent access. Lock operating means are positioned within the housing recess, and one lock is associated with the box to unlock the blocking plate when the box is properly positioned within the recess. A second lock on the box must be unlocked to enable operation of the lock operating means within the recess. The passages for the currency comprise at least two passages for separately receiving bills and coins, and the entries to the box comprise separate openings communicating with the respective passages. Separate compartments are defined within the box for maintaining the bills and coins in separate positions. The box is provided with an independent exit door whereby the bills and coins can be independently collected. This bottom door is slideable outwardly when latch means are disengaged to free the door.

22 Claims, 19 Drawing Figures

FIG. 2
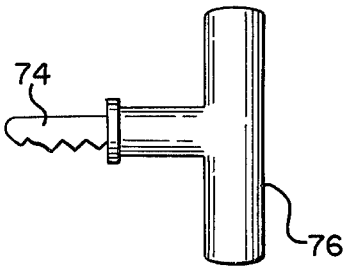
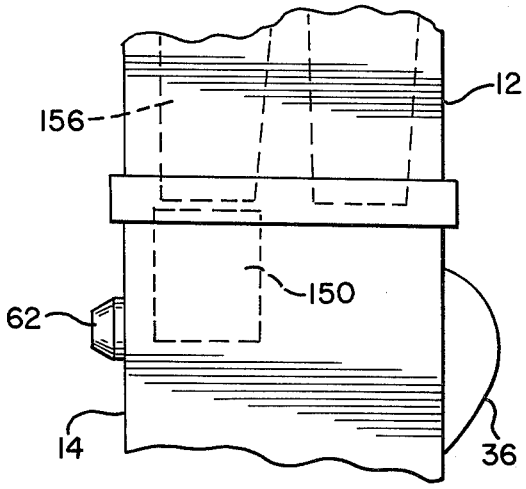
FIG. 3
FIG. 14
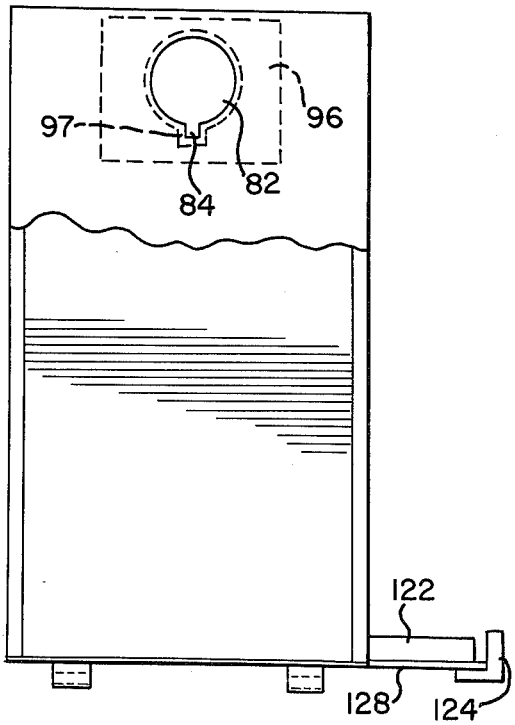
FIG. 14a
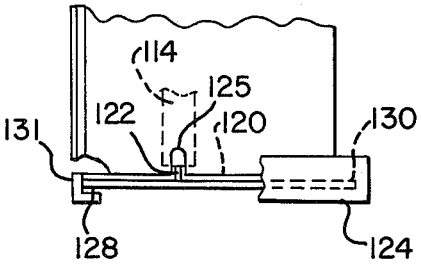

FARE COLLECTION APPARATUS

BACKGROUND OF THE INVENTION

1. Field of the Invention

This invention relates to a security system for the handling of valuables such as coins, bills, tokens and other valuables which are desirably deposited in means which provide for safe-keeping of the valuables.

The safe-keeping of valuables is of increasing concern. There is, for example, great concern regarding the protection of currency and tokens which are collected in the course of transit operations and other public transportation systems. There is also a great need to protect valuables which are collected in the course of the sale of goods or the dispensing of services.

Wherever valuables are collected, various problems arise. For example, in the case of large transit systems, fares are collected on many individual vehicles or at many different stations. Some collection systems require handling of the fares by the operator of the vehicle or by an attendant at a station. The fares are handled, for example, during transfer of the monies collected to coin changers or money bags.

Additional handling may be required when delivering fares to a central collection point. Such handling takes time, and there are also other time-consuming tasks which lead to expense such as the counting and recording of amounts collected.

Aside from the inefficiencies which characterize money collection systems, security problems are prevalent. Pilferage on the part of persons handling valuables is common in spite of a variety of measures which have been developed for preventing such pilfering.

Robbery also constitutes a serious problem in any system requiring the collection of valuables. A bus driver or gas station attendant, for example, is extremely vulnerable to robbery since a robber can take coin changers and money bags within a very short time. Drivers and attendants are particularly vulnerable at night when it is virtually impossible to provide sufficient police for preventing such occurrences.

2. Description of the Prior Art

In order to overcome the problems referred to, "exact" collection systems have been developed. In the case of transit systems, riders are required to have exact change which is deposited in a vault-like construction so that the driver or other attendant will not handle any money. Such vault arrangements are also used in other instances, such as at service stations, so that attendants do not need to handle money and are, therefore, not subject to robbery.

As explained in Dominick, et al. U.S. Pat. Nos. RE 28,307, RE 28,308, and 3,966,116, even systems utilizing more secure housings for valuables can be subject to pilferage or robbery. The systems described in these patents provide uniquely suitable arrangements for overcoming deficiencies of prior systems.

Specifically, the patented arrangements employ a housing designed for receiving and holding fares whereby visual inspection of the fares is provided. The fares are then transferred to a removable cash box which is itself a highly secure mechanism. Accordingly, when the cash box is removed, tampering is minimized so that the contents can be readily transferred to a vault. The vault structure is accommodated to the cash box to provide a highly secure arrangement for insuring safe passage into the vault.

Sesko U.S. Pat. No. 3,667,485 discloses a farebox contstruction which also includes means for visual inspection of fares. This construction specifically illustrates a pair of belts moving adjacent each other, and these belts are positioned for communication with separate deposit means. Specifically, one deposit means is provided for coins, and a separate deposit means for bills. The coins and bills are then independently viewed through a transparent window positioned adjacent the belt surfaces. Thereafter, the coins and bills are collected in a common container. (In this specification, "coins" is intended to include tokens or other coin-like checks issued by transit companies, and "bills" is intended to include tickets or other paper-like structures issued by transit companies).

SUMMARY OF THE INVENTION

This invention generally relates to an apparatus for receiving currency, a typical example of the apparatus of the invention comprising a fare collection apparatus. The structures contemplated include a housing having a deposit section for entry of coins and bills. The housing also defines a recess for removably receiving a box to be utilized for holding this currency. Passage means communicate the deposit section with entry means defined by the box.

A blocking plate or the like is utilized for normally blocking access through the entry means of the box. Separate lock structures are provided including lock operating means positioned within the recess of the housing. When the box is properly located within the recess, one lock means is operated for unlocking this lock means. A separate lock associated with the box is adapted to be unlocked with the box in place in the housing, and when both locks are operated, the blocking plate can be moved out of blocking position.

The box includes individual compartments for maintaining the coins and bills separated. In order to remove the box from the housing, the blocking plate must be returned to blocking position to prevent access to these compartments. A separate door is provided for the box which is adapted to be opened when the box is located in a collecting vault. Again, the independent lock means must be operated to achieve removal of the coins and bills which can thus be collected independently.

The box structure includes a rotatable shaft which controls the movement of the blocking plate as well as the unlatching of the separate door utilized for collecting the coins and bills after the box is removed from the housing. The separate lock means referred to are each associated with this shaft. Drive means, preferably in the form of a rack and gear, control the movement of the blocking plate when the shaft is rotated. A chute normally positioned within the box is utilized in association with the passage employed for the bills and is also controlled by the rotatable shaft. This chute is pivoted outwardly into the bill passage and the chute operates to compress the bill pile when the box is ready for removal.

The separate door of the box preferably comprises a sliding bottom door normally holding the coins and bills in the box. When moved outwardly, this door permits dumping of the contents into a vault with which the box is associated. The independent lock means must again be utilized to achieve this operation.

BRIEF DESCRIPTION OF THE DRAWINGS

FIG. 2 is side view of a key employed for operating one lock used in the apparatus;

FIG. 3 is a fragmentary, rear elevational view of the apparatus;

FIG. 14 is a front elevational view of the box with the bottom door partially open; FIG. 14*a* is a fragmentary, side view of the box illustrating the bottom door;

DESCRIPTION OF THE PREFERRED EMBODIMENTS

Figure 1:
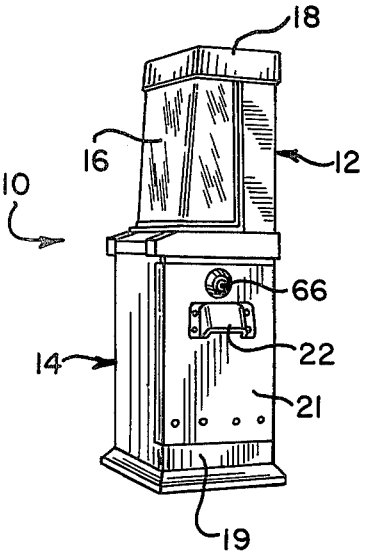
FIG. 1 is a perspective view of a fare collection apparatus characterized by the features of this invention.
Figure 4:
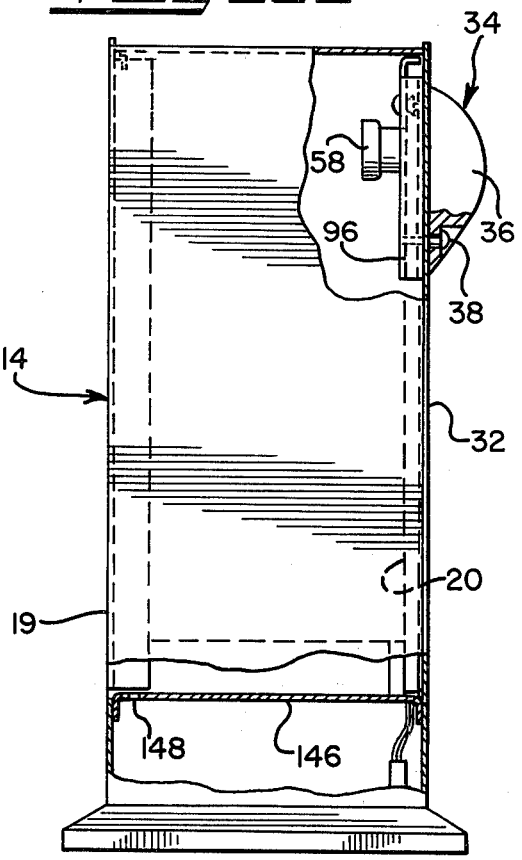
FIG. 4 is a rear elevational view, partly cut away, of the lower housing section of the construction.

FIG. 1 of the drawings illustrates a fare collection apparatus 10 including an upper housing section 12 and a lower housing section 14. The upper housing section includes a window 16, and any suitable means for collecting currency will be associated with this upper section. Reference is made, for example, to the aforementioned Sesco patent wherein a pair of belts are provided for separately receiving coins and bills deposited. A system of that general type may be employed with suitable separate deposit areas being provided at the top 18 of the apparatus.

The lower section 14 includes an access opening in the wall 19 with a large recessed area 20 being defined within this lower section for receiving a fare collection box or container 21. A handle 22 is provided on the face of this box whereby the box can be inserted and removed from the lower section 14.

Figure 6:
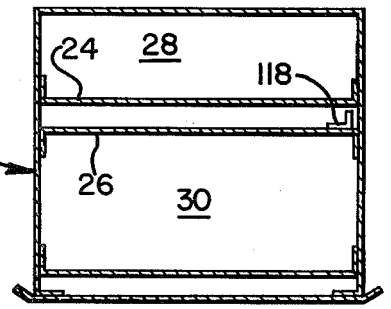
FIG. 6 is a horizontal, sectional view of the fare collection box taken about the line 6—6 of FIG. 10.
Figure 7:
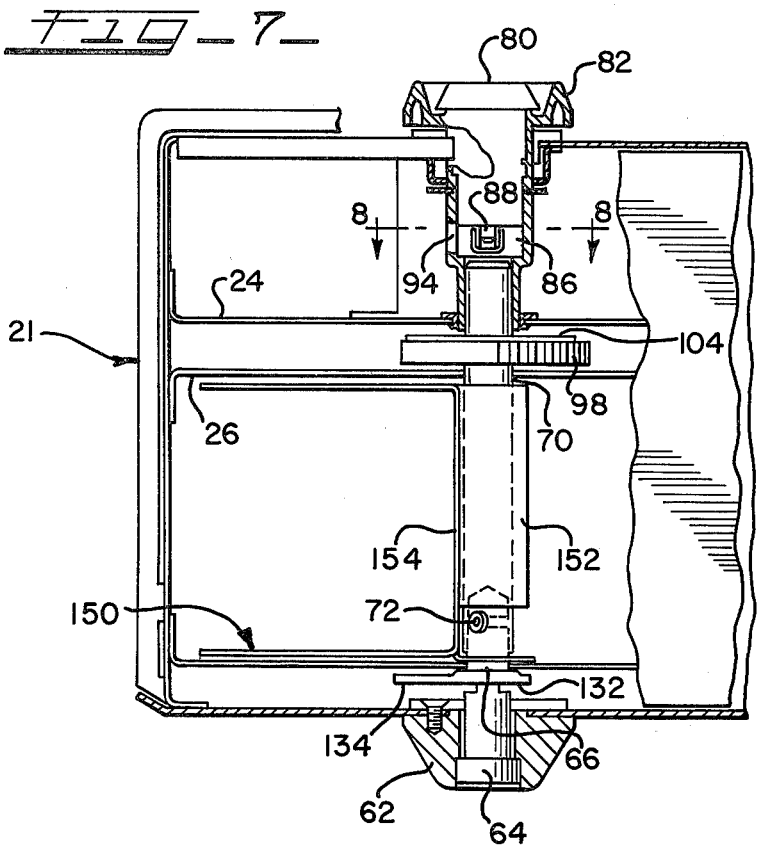
FIG. 7 is a fragmentary, cross-sectional view of the box utilized in the construction.
Figure 8:
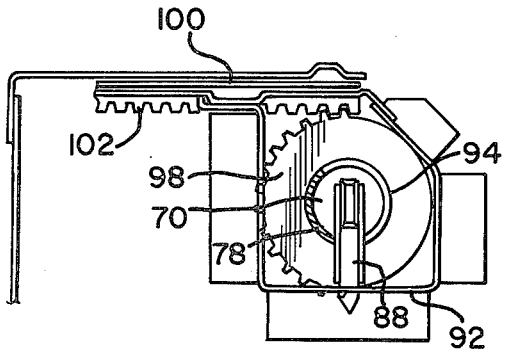
FIG. 8 is an enlarged, fragmentary view taken about the line 8—8 of FIG. 7.
Figure 9:
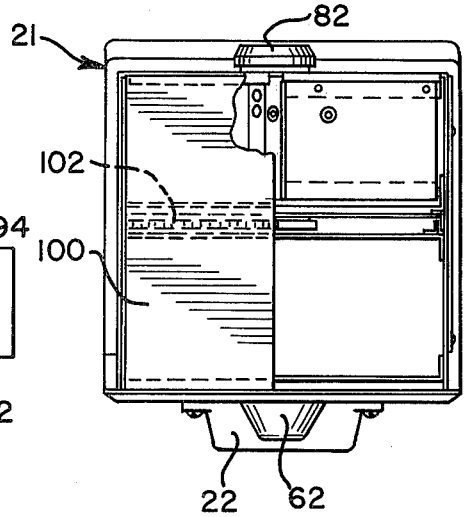
FIG. 9 is a top view of the box, partly cut away.

As best shown in FIG. 6, the box 21 includes internal partitions 24 and 26. These divide the box into a first compartment 28 for holding coins and a second compartment 30 for holding bills.

Figure 5:
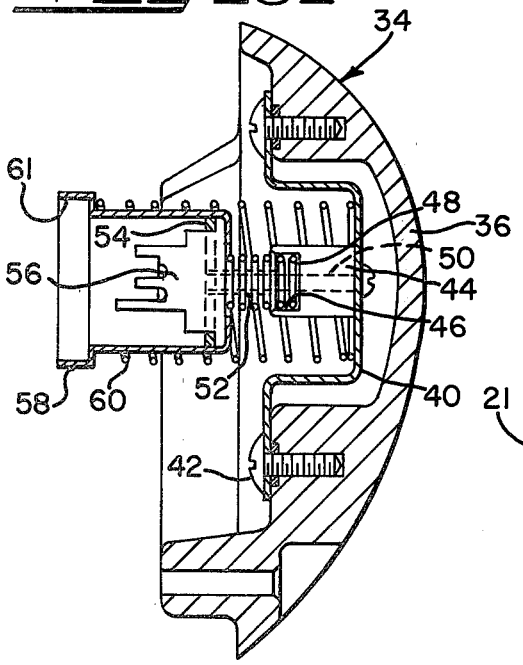
FIG. 5 is a vertical, sectional view of the key supporting assembly associated with the lower housing section.

The wall 32 of the lower section 14 supports the assembly 34 illustrated in detail in FIG. 5. This assembly includes a cover 36 which is preferably formed of a strong impact-resistant material and which is secured to the wall 32 by bolts 38. This cover has a transversely extending supporting plate 40 secured thereto by means of fasteners 42. A block 44 is attached to the plate 40, and a seat 46 is defined by the block for receiving spring 48.

A pair of pins 50 extend outwardly from the plate 40 through the block 44 on opposite sides of spring 48, and bushings 52 receive these pins. The bushings are attached to a retaining ring 54 employed for confining key 56 within cup 58. This cup is normally urged outwardly of the plate 40 by means of spring 60. The cup 58 serves as a guide and alignment means when the lock 80 associated with the box 21 is inserted. The spring 60 permits, in particular, the engagement of cup edge 61 with the groove defined between the lock 80 and surrounding ring 82. Spring 48 permits some movement of key 56 to insure alignment within lock 82.

The box 21 carries a fixture 62 which is positioned above the handle 22. This fixture supports lock 64 which includes a rotatable shaft portion 66 tied to drive shaft 70 by means of screw 72. The lock 64 may comprise any conventional lock operable upon insertion of key 74 (FIG. 1). The key 74 carries a handle 76 to provide for the application of adequate force for turning drive shaft 70 and the associated components.

The end of shaft 70 is tied to the cylindrical portion 78 of a tubular lock 80 supported at the back of the box 21. This cylindrical portion includes an integrally formed annular section 82 which supports at least one tang 84. The inner lock portion 86 supports a keeper 88 which is received by an opening defined by an underlying plate 92. This maintains the inner portion in a stationary position within the box. A slot 94 is defined in the wall of the cylindrical section 78 to thereby permit rotation of this cylindrical section through 180°.

The back wall 32 of the lower housing section 14 defines an inwardly formed portion 96. This wall portion defines notch 97 (FIG. 14) for receiving tang 84 when the box 21 is being moved into position. Upon rotation of the annular section 82, the tang is positioned behind this wall portion to thereby secure the box within the housing. It will be appreciated that this provides a latch arrangement preventing removal of the box from the housing until the annular section 82 is returned to its original position with the tang 84 aligned with the notch.

The shaft 70 defines a non-circular portion which receives a non-circular opening defined by gear 98 whereby the gear rotates with the shaft. A blocking plate 100 carries rack 102 meshing with this gear. Accordingly, the blocking plate is adapted to be moved back and forth between blocking and non-blocking positions.

A disc 104 is attached to gear 98 by means of pins 106 which are received in slots 108 defined by this disc. The pin and slot relationship provides a lost motion arrangement whereby the movement of the disc upon rotation of shaft 70 is limited when compared with the movement of gear 98.

Pin 110 secures a bottom door locking arm 112 to the disc 104. This locking arm carries a vertically movable bar 114 which is attached by means of pin 116. An angle member 118 is supported on partition wall 26 to provide as a guide means for the bar 114, and movement of disc 104 operates to raise and lower the bar.

The bottom wall of the box consists of a horizontally extending plate 120, and an intermediate right angle member 122. One end of the plate 120 supports a cross member 124, and a gap 126 is defined between this cross member and the member 122.

Figure 10:
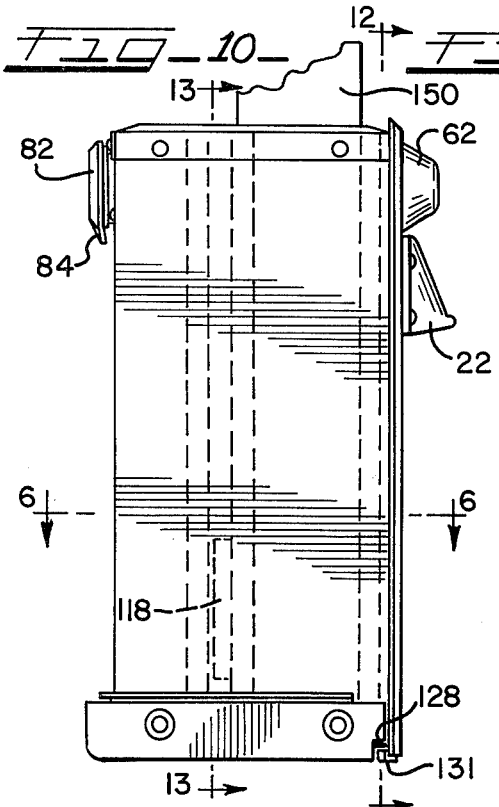
FIG. 10 is a side elevational view of the box.

This bottom wall assembly is adapted to slide outwardly of the box as shown in FIGS. 14 and 14*a* whereby the bottom of the box can be completely opened. The wall 123 of the box defines slot 125 to permit passage of member 122. The bottom plate 120 includes edges 128 and 130 which are received in grooves defined by side members 131 supported by the front and back walls of the box in the manner shown in FIGS. 10 and 14*a*.

Figure 13:
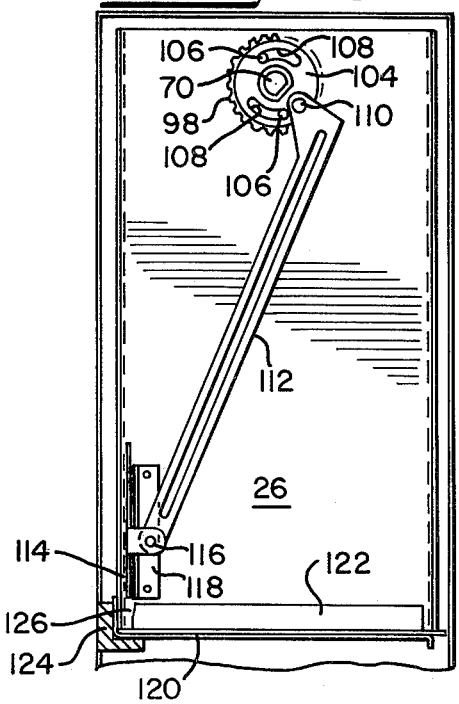
FIG. 13 is a fragmentary, vertical cross-sectional view taken about the line 13—13 of FIG. 10.
Figure 17:
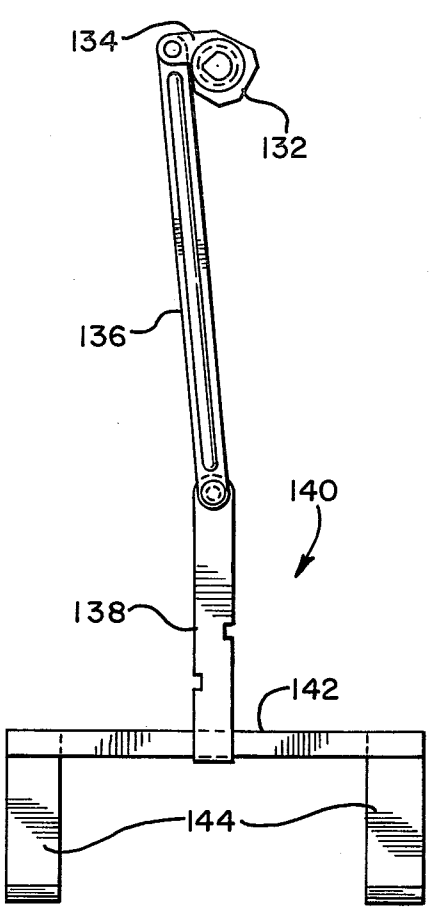
FIG. 17 is a detailed, elevational view of a box latch employed for securing the box relative to the apparatus housing; and, FIG. 18 is a side view of the latch of FIG. 17.
Figure 18:
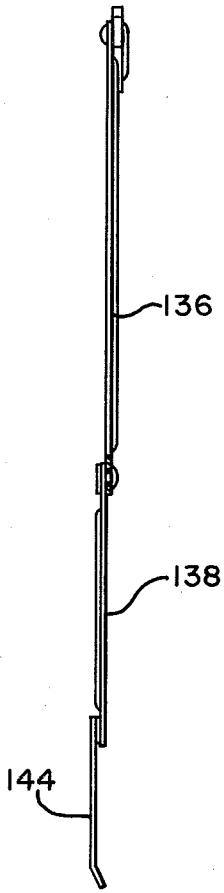
Figure 15:
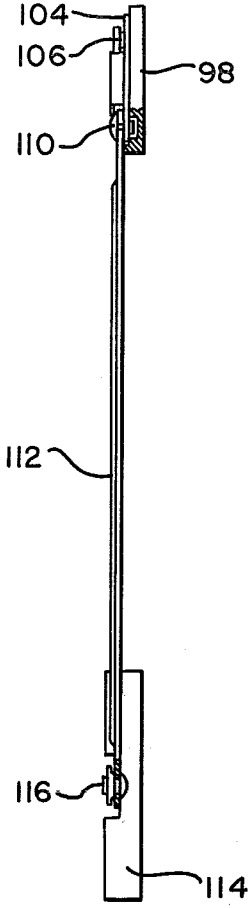
FIG. 15 is a side view of the bottom door latching means.
Figure 16:
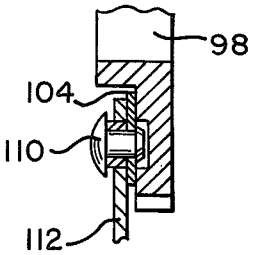
FIG. 16 is an enlarged, fragmentary, cross-sectional view illustrating the connection of the bottom door latching means and the associated gear.

When the bar 114 is lowered from the position shown in FIG. 13, the bar will be received within the gap 126 thereby latching the bottom wall assembly against sliding movement. It will be appreciated that the bottom wall will be latched whenever the box is separated from the housing section 14 or from an appropriate collection vault or the like. It will also be appreciated that even though the bottom wall assembly is released while the box is within the lower housing section 14, the bottom wall cannot be moved since the walls of the housing section prevent this.

The members 124 and 131 along with other peripheral members 127 are preferably made of a resilient material such as a polycarbonate. These members extend outwardly and serve as bumpers to absorb impact and thus minimize damage to the box.

The rotatable portion of lock 64 supports a disc 132 which includes a supporting arm 134. This arm has link 136 connected thereto, and the link is attached to vertical member 138 of a latching assembly 140. The latching assembly includes cross bar 142 and vertically extending feet 144.

The recess adapted to receive box 21 defines a horizontal bottom wall 146 which defines suitable slots at 148 for receiving feet 144. When the box is inserted in the recess, the feet 144 are in an elevated position so that the box is free to be positioned within the recess. Upon rotation of shaft portion 66, however, the feet 144 are lowered into the slots 148. These feet thus latch the box against withdrawal from the recess. The feet, therefore, act in unison with tangs 84 associated with the box to prevent removal of the box whenever access to the storage compartments of the box becomes possible.

Figure 11:
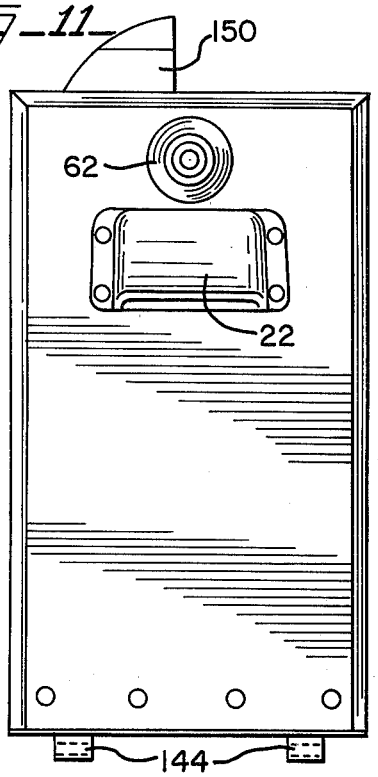
FIG. 11 is a front elevational view of the box.
Figure 12:
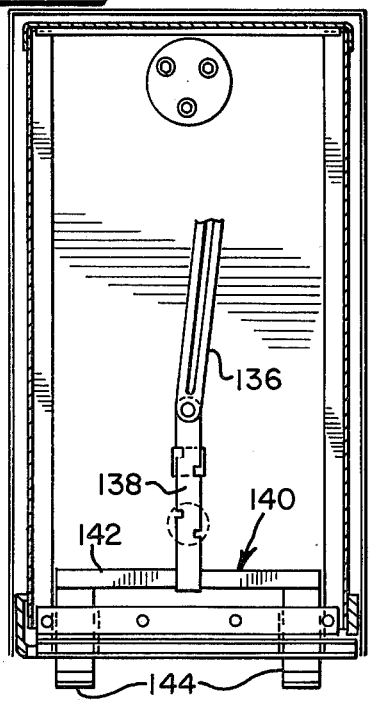
FIG. 12 is a fragmentary, vertical cross-sectional view taken about the line 12—12 of FIG. 10.

The shaft 70 also supports a chute assembly 150. This assembly includes a cylindrical portion 152 tied to the shaft and integrally formed walls 154 extending outwardly from the shaft. The chute is positioned adjacent the passage 156 which receives bills. Specifically, the chute forms a continuation of this passage when it is raised to the position shown in FIG. 11. The chute is considered particularly useful because it prevents insertion of a piece of cardboard or other thin barrier over the openings in the top of the box. The chute also acts to guide bills in a straight path from the passage 156. Finally, the chute is useful where a relatively large amount of currency has been deposited to the extent that some currency may settle in position above the top wall of the box. When the blocking plate 100 is being moved to a closed position, the chute will pivot downwardly at the same time. The back wall 154 of the chute will then press the bills into the compartment.

In the use of the construction of the invention, the housing may be located on a bus. At the commencement of a route, an empty box 21 will be located in the lower housing 14 with the key 56 of this lower housing fitting the lock 80 carried by this box. In addition, the person loading the box will have a separate key 74 for operating lock 64. This provides a distinct security measure since the person installing the box knows which box can be associated with a particular housing, and he must also have possession of the correct key for that box.

By turning the key 74, the blocking plate 100 will be moved to the open position, and the chute 150 will be raised. Simultaneously, the feet 144 will be lowered into slots 148 thereby securing the box in the lower housing. Furthermore, the tang 84 will engage wall portion 98 to provide an added insurance against unauthorized removal of the box.

It will be noted that the described operation will also result in lifting of the bar 114 which would permit sliding movement of the bottom door 120. As noted, however, this door is blocked against movement by the adjacent housing wall.

When the bus has completed its route, or at some intermediate collection position, authorized personnel having possession of a key 74 can remove the box 21. The reverse operations take place during the removal since the key 74 must be used for rotating the drive shaft 180° in the reverse direction in order to disengage the feet 144 and in order to locate the tang 84 opposite notch 97. The box can now be moved outwardly which releases lock 80 from engagement with key 56. This, therefore, prevents rotation of drive shaft 70 even if the operator attempts to operate lock 64 by means of key 74.

The box can now be moved to a collection station for removal of the bills and coins collected. As noted, the system of this invention provides separate passages in the upper housing for separate interior compartments 28 and 30, these bills and coins remain separated in the box 21. Accordingly, the structure permits separate collection of the bills and coins in a suitable vault.

The provision of the sliding bottom door 120 is of significant value in this respect. Thus, the door is characterized by an uncompleted structure and mode of operation. By sliding the door outwardly and by providing separate vault compartments aligned with the box compartments 28 and 30, the currency in the box will simply fall by gravity into the vault, it being noted that the interior wall surfaces are unrestricted, free of hinges or the like which could cause the currency to "hang up." A completely enclosed vault provided with a key 56 and including automatic means for driving the door in response to rotation of key 74 is contemplated. Alternatively, drive means can be engaged with annular member 82 at the back of the box.

It will be understood that various changes and modifications may be made in the above described construction which provide the characteristics of the invention particularly as defined in the following claims.

That which is claimed is:

1. In an apparatus for receiving currency including a housing having a deposit section, a box for holding the currency, a recess in the housing for removably receiving the box, passage means for the currency defined between said deposit section and said recess, and entry means defined by the box adapted for communication with said passage means, blocking means for closing said entry means, lock means holding the blocking means in blocking position to prevent access to said box, and lock operating means for unlocking paid lock to enable movement of said blocking means from blocking position when the box is positioned within said recess, the improvement wherein said passage means comprise at least two passages for separately receiving bills and coins, said entry means comprising separate openings defined by the box, said blocking means comprising a horizontally movable plate, said plate being movable between positions covering said openings and exposing said openings, a rack secured to said plate, a shaft supported by said box, and a gear mounted on said shaft, said gear engaging said rack whereby rotation of said shaft operates to move said plate, movement of said plate providing communication of one passage with one opening and the other passage with the other opening, and compartments defined within said box, each opening communicating with a separate compartment whereby the bills and coins are separated within the box, said lock means comprising first and second locks associated with said shaft, a first key positioned within said recess for engagement with one lock at one end of said shaft when the box is received within said housing, and a second lock positioned at the other end of said shaft and exposed on the exterior of said box.

2. An apparatus in accordance with claim 1, including a second key removably insertable into said second lock, said second key being adapted for application of rotary force to said shaft when said box is within said recess.

3. An apparatus in accordance with claim 2 including a pivotal chute supported on said shaft, rotation of said shaft operating to move said chute into the passage employed for receiving bills whereby said bills move through said chute and into a compartment of said box, return movement of said chute operating to compress bills extending beyond said compartment.

4. An apparatus in accordance with claim 1 including a bottom wall for said box, means slideably supporting said bottom wall relative to the box whereby said bottom wall is adapted to be driven horizontally outwardly of the box to thereby expose said compartments, and including means normally latching said wall against sliding movement relative to the box.

5. An apparatus in accordance with claim 4 including means operatively connecting said means for latching to said blocking means whereby movement of said blocking means simultaneously results in movement of said means for latching said bottom wall.

6. An apparatus in accordance with claim 5 wherein said means operatively connecting said means for latching and said blocking means comprise a drive shaft associated with said box, said lock means being connected to said drive shaft.

7. An apparatus in accordance with claim 6 wherein said means for latching include a drive arm connected to said shaft, and a bar connected to said drive arm, said bar being adapted to be interposed in the path of sliding movement of said bottom wall for latching the bottom wall.

8. In an apparatus for receiving currency including a housing having a deposit section, a box for holding the currency, a recess in the housing for removably receiving the box, passage means for the currency defined between said deposit section and said recess, and entry means defined by the box adapted for communication with said passage means, blocking means for closing said entry means, lock means holding the blocking means in blocking position to prevent access to said box, and lock operating means for unlocking said lock to enable movement of said blocking means from blocking position when the box is positioned within said recess and further including means for latching said box in position within said housing, the improvement wherein said passage means comprise at least two passages for separately receiving bills and coins, said entry means comprising separate openings defined by the box, movement of said blocking means providing communication of one passage with one opening and the other passage with the other opening, compartments defined within said box, each opening communicating with a separate compartment whereby the bills and coins are separated within the box, means operatively connecting said means for latching with said blocking means whereby movement of said blocking means results in latching of the box within the housing, said means operatively connecting said means for latching and said blocking means comprising a drive shaft associated with said box, said lock means being connected to said drive shaft, said means for latching including a link connected to said shaft, locking feet means connected to said link, said feet means being adapted to be engaged with openings in said housing to prevent movement of the box relative to the housing, and an annular member connected to said shaft, tang means defined by the annular member, a notch in a wall of said housing receiving said tang means, rotation of said shaft moving said tang means behind said wall to secure said box within said recess.

9. In an apparatus for receiving currency including a housing having a deposit section, a box for holding the currency, a recess in the housing for removably receiving the box, passage means for the currency defined between said deposit section and said recess, and entry means defined by the box adapted for communication with said passage means, blocking means for closing said entry means, lock means holding the blocking means in blocking position to prevent access to said box, lock operating means for unlocking said lock to enable movement of said blocking means from blocking position when the box is positioned within said recess, and a bottom wall for said box, the improvement comprising means slideably supporting said bottom wall relative to the box whereby said bottom wall is adapted to be driven horizontally outwardly of the box to thereby expose the interior of said box, and including means operatively connected to said blocking means normally latching said wall against sliding movement relative to the box whereby movement of said blocking means simultaneously results in movement of said means for latching said bottom wall, said means operatively connecting said means for latching and said blocking means comprising a drive shaft associated with said box, said lock means being connected to said drive shaft, and wherein said lock means comprise first and second locks associated with said shaft, a first key positioned within said recess for engagement with one lock at one end of said shaft when the box is received within said housing, a second lock being positioned at the other end of said shaft and exposed on the exterior of said box.

10. An apparatus in accordance with claim 1 wherein said means for latching include a drive arm connected to said shaft, and a bar connected to said drive arm, said bar being adapted to be interposed in the path of sliding movement of said bottom wall for latching the bottom wall.

11. In an apparatus for receiving currency including a housing having a deposit section, a box for holding the currency, a recess in the housing for removably receiving the box, passage means for the currency defined between said deposit section and said recess, and entry means defined by the box adapted for communication with said passage means, blocking means for closing said entry means, lock means holding the blocking means in blocking position to prevent access to said box, lock operating means for unlocking said lock to enable movement of said blocking means from blocking position when the box is positioned within said recess, and a drive shaft supported by said box, the improvement wherein said lock means comprise first and second locks associated with said shaft, a first key positioned within said recess for engagement with one lock at one end of said shaft when the box is received within said housing, and a second lock positioned at the other end of said shaft and exposed on the exterior of said box.

12. An apparatus in accordance with claim 11 including a second key removably insertable into said second lock, said second key being adapted for application of rotary force to said shaft when said box is within said recess.

13. An apparatus in accordance with claim 12 including a bottom wall for said box, means slideably supporting said bottom wall relative to the box whereby said bottom wall is adapted to be driven horizontally outwardly of the box to thereby expose said compartments, and including means normally latching said wall against sliding movement relative to the box.

14. An apparatus in accordance with claim 13 including means operatively connecting said means for latching to said blocking means whereby movement of said blocking means simultaneously results in movement of said means for latching said bottom wall.

15. An apparatus in accordance with claim 14 wherein said means operatively connecting said means for latching and said blocking means comprise said drive shaft.

16. An apparatus in accordance with claim 15 wherein said means for latching include a drive arm connected to said shaft, and a bar connected to said drive arm, said bar being adapted to be interposed in the path of sliding movement of said bottom wall for latching the bottom wall.

17. An apparatus in accordance with claim 13 including bumper means formed around the lower peripheral edge of said box, said bumper means being formed of a resilient material, and including grooves defined by the bumper means for slideably receiving side edges of said bottom wall.

18. An apparatus in accordance with claim 11 including means for latching said box in position within said housing, and means operatively connecting said means for latching with said blocking means whereby movement of said blocking means results in latching of the box within the housing.

19. An apparatus in accordance with claim 18 wherein said means operatively connecting said means for latching and said blocking means comprise said drive shaft.

20. An apparatus in accordance with claim 19 wherein said means for latching includes a link connected to said shaft, and locking feet means connected to said link, said feet means being adapted to be engaged with openings in said housing to prevent movement of the box relative to the housing.

21. An apparatus in accordance with claim 19 wherein said means for latching include an annular member connected to said shaft, tang means defined by the annular member, a notch in a wall of said housing receiving said tang means, rotation of said shaft moving said tang means behind said wall to secure said box within said recess.

22. An apparatus in accordance with claim 11 wherein said passage means include at least two passages for separately receiving bills and coins, including a pivotal chute supported on said shaft, rotation of said shaft operating to move said chute into the passage employed for receiving bills whereby said bills move through said chute and into a compartment of said box, return movement of said chute operating to compress bills extending beyond said compartment.

* * * * *